US008881715B2

(12) United States Patent
Brandt

(10) Patent No.: US 8,881,715 B2
(45) Date of Patent: Nov. 11, 2014

(54) CONCRETE SAW

(76) Inventor: Alan Brandt, Sparks, NV (US)

( * ) Notice: Subject to any disclaimer, the term of this patent is extended or adjusted under 35 U.S.C. 154(b) by 556 days.

(21) Appl. No.: 13/179,737

(22) Filed: Jul. 11, 2011

(65) Prior Publication Data

US 2013/0014737 A1 Jan. 17, 2013

(51) Int. Cl.
*B28D 1/04* (2006.01)

(52) U.S. Cl.
CPC ..... *B28D 1/045* (2013.01)
USPC ..... 125/14; 125/38; 451/350

(58) Field of Classification Search
USPC ..... 125/12, 13.01, 13.03, 14, 38; 280/239, 280/241, 251, 350; 299/39.1, 39.3, 58; 451/344, 350, 352
See application file for complete search history.

(56) References Cited

U.S. PATENT DOCUMENTS

| | | | | |
|---|---|---|---|---|
| 3,407,005 | A | 10/1968 | Simms et al. | |
| 3,606,469 | A | 9/1971 | Hughes | |
| 3,694,033 | A | 9/1972 | Rowley | |
| 3,802,742 | A * | 4/1974 | Zuzelo | 299/39.2 |
| 4,921,308 | A * | 5/1990 | Yelton et al. | 299/39.3 |
| 4,936,284 | A | 6/1990 | Johnson | |
| 5,511,809 | A * | 4/1996 | Sagi | 280/209 |
| 5,724,956 | A | 3/1998 | Ketterhagen | |
| 5,743,247 | A * | 4/1998 | Kingsley et al. | 125/12 |
| 5,803,071 | A * | 9/1998 | Chiuminatta et al. | 125/13.01 |
| 6,131,557 | A * | 10/2000 | Watson | 125/13.01 |
| 6,203,112 | B1 * | 3/2001 | Cook et al. | 299/39.3 |
| 7,418,959 | B2 * | 9/2008 | Kingsley et al. | 125/13.01 |
| 7,494,141 | B2 * | 2/2009 | Bouton | 280/124.103 |
| 7,669,589 | B2 * | 3/2010 | Kingsley et al. | 125/13.01 |
| 2007/0131211 | A1 * | 6/2007 | Howard et al. | 125/13.01 |
| 2011/0147108 | A1 * | 6/2011 | Hecht et al. | 180/233 |

* cited by examiner

*Primary Examiner* — Timothy V Eley
(74) *Attorney, Agent, or Firm* — Frank J. Dykas; Dykas & Shaver

(57) ABSTRACT

Presented is a concrete saw for sawing into concrete surfaces to provide expansion slots or joints. The concrete saw has powered front wheels and may optionally have powered rear wheels, so that with improved traction the full potential of the motor can be utilized in faster cutting of concrete.

3 Claims, 5 Drawing Sheets

CONCRETE SAW

TECHNICAL FIELD

1. Field

The present disclosure involves concrete saws, and more particularly self propelled concrete saws which saw expansion slots into concrete surfaces.

2. Background

Walk behind saws typically are driven by the rear wheels and have a saw blade mounted in front of the front wheels. Saws have been designed and manufactured with either upcut or down cut blade rotation. Both designs have some inherent operational deficiencies that inhibit maximum machine and blade performance.

Up cut blade rotation keeps the blade in the cut, the blade "pulls down" when cutting. This pull down will take weight off or "lift" the rear of the saw causing loss of traction. In order to counter this problem the front wheels of the saw have been located very close to the blade shaft to counter the fulcrum effect. Maximum tractive effort is required for upcut saws due to the tendency of the blade to "push back" when cutting. Weight is added to the rear of the saw to increase traction. The additional weight and the location of the front wheels make the saw very heavy and difficult to maneuver and operate.

Down cut blade rotation helps propel the saw when cutting but has a tendency to "ride out" of the cut. As the saw rides out weight is transferred to the rear wheels, which does increase traction somewhat. However when the blade rides out cutting depth will not be maintained. On wet or slippery surfaces traction can be lost causing the saw to become difficult to operate resulting in a loss of production.

Saws are designed to cut straight lines. To counter blade pull that occurs when cutting the rear axle can be adjusted to "steer" the saw in the opposite direction of the pull.

What is needed is a machine drive design that can be incorporated with either the up cut or down cut cutting methods that will maximize blade and machine performance.

Because of its high strength and durability, concrete is often used in the construction of roadways, airports, runways, floors, foundations and other structures. Often, concrete saws are used to cut slots, seams or other cuts in the concrete in order to establish joints to control stress cracks as the slabs cure or form channels or openings where other structures may be placed. The saws required to perform such labor are typically slow and have poor weight distribution between the rear (drive) wheels and the front wheel.

Walk behind saws consist of a set of wheels supporting a frame and attached to that frame is a motor or other power supply for driving one or more wheels so that the saw can move under its own power. The motor may also provide power for operating a saw blade attached to the saw frame. Also attached to the saw frame are one or more handles which may be used by the operator to position the saw.

During operation the operator walks behind the saw and controls operating conditions such as the direction, speed, and cutting depth of the saw.

Typically, the saw blade is mounted to the machine in front of the front wheels, and the rear wheels are typically the drive wheels. Typically such saws are heavier on the front wheels than on the rear wheels. This configuration results in a loss of traction, due to the rear wheels having less weight. This weight distribution can lead to loss of traction to the drive wheels when traveling over wet or otherwise slippery terrain.

A loss in traction may cause the machine to operate at a slower rate of travel than would occur in the absence of such slippage.

When the machine slows due to lost traction the operator may be prone to push the machine forward. This action results in a saw with a down cut rotation "riding up" in the cut. Once this occurs the saw will be cutting at a depth sallower than is desired.

Traditional machines are may also be difficult to maneuver due to inadequate steering mechanisms that are compounded by each wheel being locked to the respective axle. During a turn this configuration results in the inside wheel and outside wheel turning at the same speed while each wheel is traveling at a different speed across the surface. The typical method of steering is for the operator to lift the saw blade fully out of the cut, then to unweight the front wheels by pressing down at the rear of the machine. The wheels are typically not steerable, and this kind of turning is the same action as when turning a law mower, by lifting the front wheels up, then turning the whole machine.

What is needed is a saw that can fully utilize the horse power of the motor, to achieve faster cutting through better traction, from using front wheel drive or all wheel drive to pull and push the concrete saw over wet concrete, sand covered concrete, and other areas where tires lose traction.

SUMMARY OF THE DISCLOSURE

Disclosed is a concrete saw which utilizes either front wheel drive or all wheel drive, in order to fully utilize the horse power of the motor. The concrete saw includes a saw frame with two rear wheels and typically two front wheels. The concrete saw includes a wheel drive motor attached to the frame and configured to provide power to the left and right front and rear wheels. In certain configurations of the saw, the rear wheels are also drive wheels, but in all configurations the front wheels are drive wheels. This takes advantage of the typical design of such a concrete saw, in which most of the weight is on the front axle of the saw. A concrete saw of the disclosed technology can be a 4 wheel saw, can have one wheel in front and two in the rear, or two wheels in the front and one in the back. If a single wheel is present, either in the rear or front, it can be of increased width to provide added road contact.

The concrete saw includes a saw blade and a saw motor to power the saw blade. In one configuration, the rear wheels are connected to the one or two front wheels in a way that causes all wheels to be powered, thus making the concrete saw have all wheel drive. Using gears and chains to transfer power is one option, and another option is to use a single hydraulic pump to power hydraulic motors that are attached to the front wheels or all wheels, as well as the saw blade.

In one embodiment of the concrete saw, the saw includes a left and right front wheel which is on a front axle. In one version of the saw, the wheel drive motor is connected to the rear wheels and the rear axle by a chain, with a first sprocket on the wheel drive motor and a second sprocket on the rear wheel axle. Thus, when the motor turns, the first sprocket turns a primary chain which drives the rear wheel axle.

This version of the concrete saw also includes a third sprocket which is on the front axle, which is connected to a fourth sprocket which is on the rear axle. Thus, when the wheel drive motor turns the rear axle with the primary chain, a secondary chain on the third and fourth sprocket transfers that power to the front axle.

Another embodiment of the concrete saw is one which is driven by front wheel drive. In this configuration, the wheel drive motor would utilize one or more idler sprockets on the rear axle to drive the front wheels. The idler sprockets would rotate but do not drive the rear wheels.

The concrete saw may be walk behind or maybe a rideable version, and is for cutting a surface including a rotatable blade where either the front axle only or both front and rear axles are supplied with a rotational force to move the machine. In one example, this force can be supplied by connecting a chain to a sprocket on the motor driveshaft and the opposite end of the chain to a drive sprocket on the rear axle. Power is taken from the rear axle and delivered to the front axle by a second chain attached to the rear axle by a drive sprocket with the opposing end of the chain engaging a sprocket on the front axle. However, other means of powering the wheels including, but not limited to, a shaft drive mechanism could be utilized without defeating the spirit and intent of the invention claimed.

One possible change for improved maneuverability could be achieved by allowing the drive wheels to rotate at different rates while turning. This could be accomplished by installing an axle differential so as to allow the outside wheels to rotate at ground speed while the interior wheel continues to supply the motive force from the axle.

By providing drive wheels on the front axle, where the most weight is supported, the traction is maximized and the full potential of the horsepower of the motor is more fully utilized. This results in increased speed of cut, which may require an upgraded saw blade to handle the increased speed of cutting that better traction can provide.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept(s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

Figure 1:
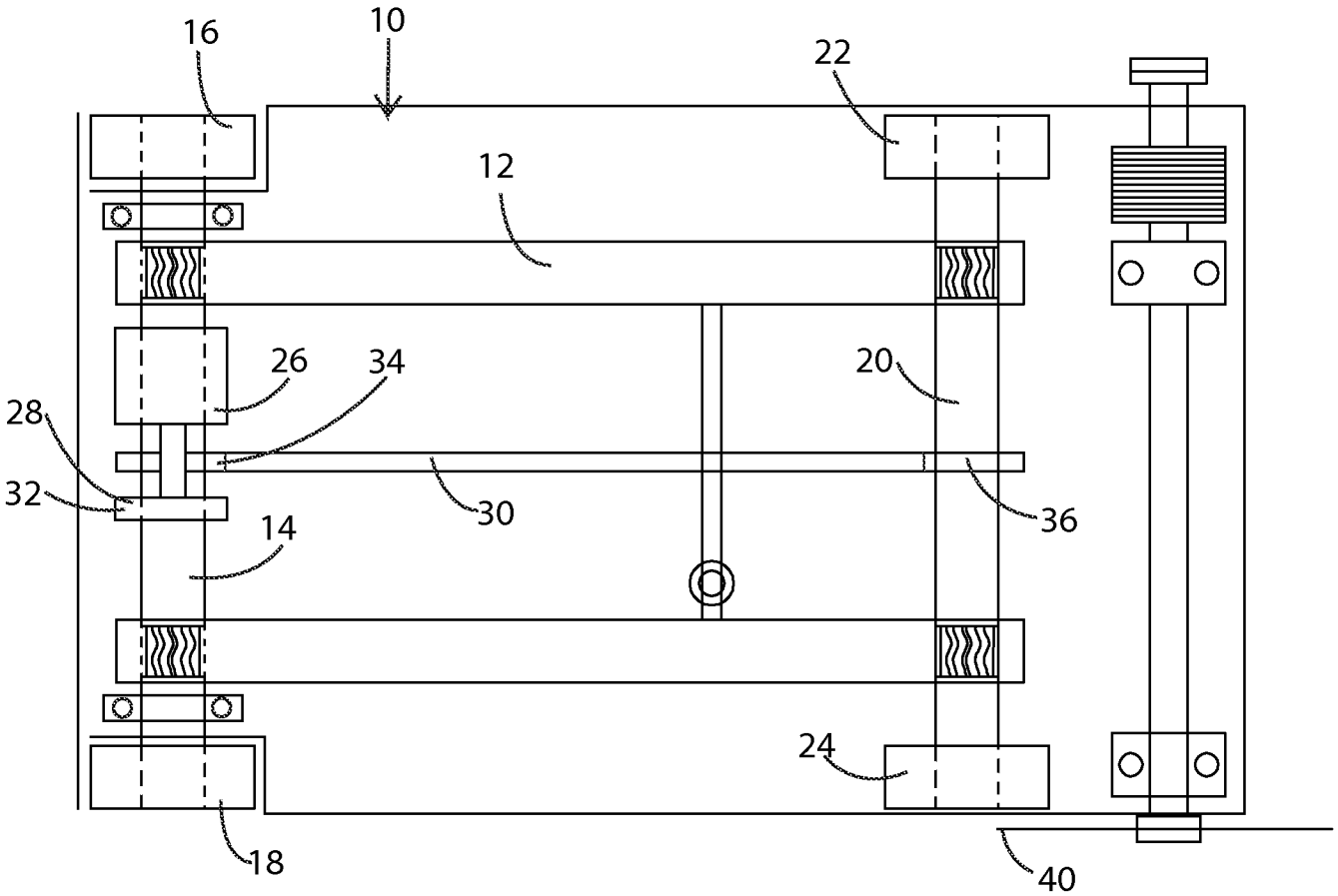
FIG. 1 is a top view of the concrete saw.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIGS. 1 through 5 show a preferred embodiment of the concrete cutter of the disclosed technology. Although the chain drive is presently a preferred embodiment, it is to be understood that other drive systems are possible and are envisioned to fall within the scope of the claims. An alternative drive system includes one in which power is provided by a hydraulic pump, in which hydraulic motors may be attached to the wheels and saw and be powered by the same hydraulic pump. The hydraulic pump would thus serve as the wheel drive and the saw drive. The significant parts of the disclosed technology is that the front wheel or wheels are powered and pull the saw forward. The rear wheels may optionally be powered. The significance of this is that the front wheels typically have more weight then the rear wheels. In one example, the front wheels may have 1800 pounds of weight on them, while the rear wheels may only have 200 pounds on them. Even though the added weight on front wheels would provide more traction for pulling, prior art concrete saws utilize the rear wheels to steer, and combine the steering driving function in the rear.

Figure 3:
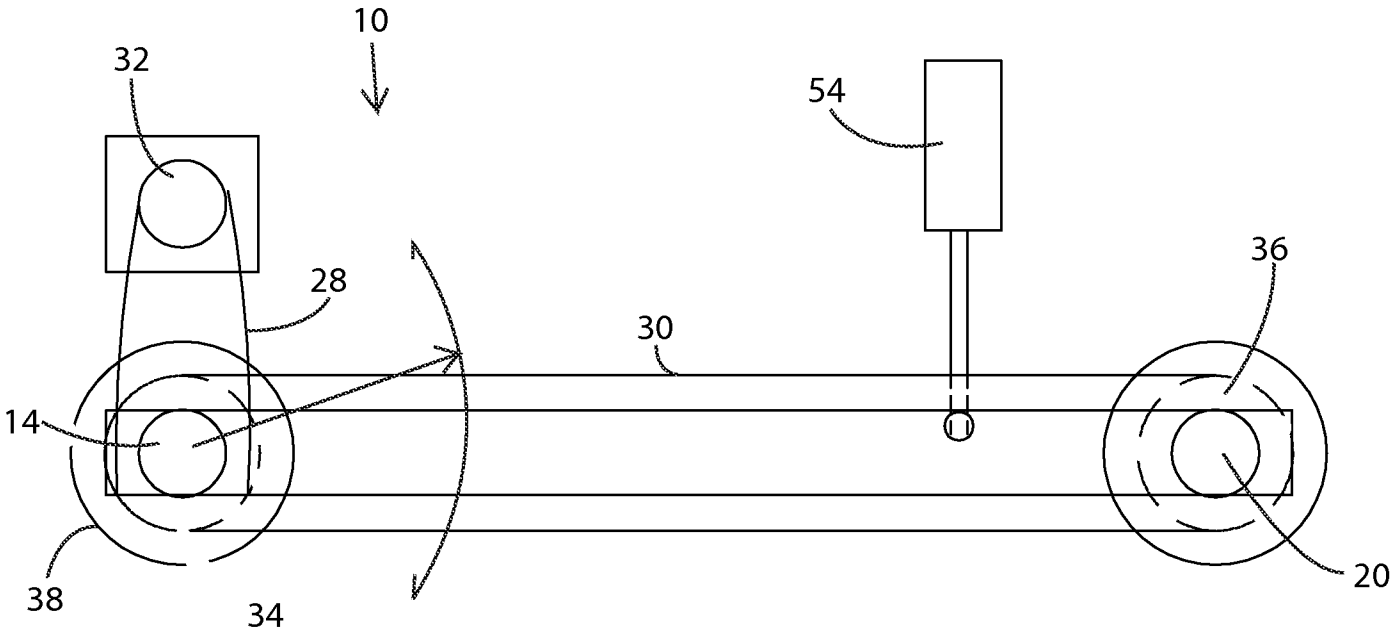
FIG. 3 is a side view of the concrete saw.

Shown in FIG. 1 is the all-wheel-drive assembly for a concrete saw. FIG. 1 shows the frame 12, the rear axle 14, the left rear wheel 16, the right rear wheel 18, the wheel drive motor 26, the primary chain 28, the chain 30, the front axle 20, the left front wheel 22 the right front wheel 24. Horizontal plate 10, which is shown representational in FIG. 1 is positioned atop frame 12 to complete the frame assembly and provides suitable attachment points for the motor 26 and other standard concrete saw components which are well known in the art and play no part in the present invention. Horizontal plate 10 is rotationally attached to rear axle 14 by means of pillow block bearing assemblies 11, and merely rests atop the front portion of frame 12 such that concrete saw 10 can be pivoted in an arc centered around rear axle 14 as shown in FIG. 3 by arc lines 35.

This basic configuration of the concrete saw can be configured in a number of different ways, with the following being one example which is proven to be a suitable configuration. Another known configuration is one driven by a hydraulic motor, which may drive all wheels and the saw.

In the configuration shown in FIG. 1, the frame 12, is made of steel plate ¼ inch in thickness. At the rear end of the frame 12, is located a rear axle 14, which in one embodiment is made of 1¼ inch diameter steel and is approximately 30 inches in length. Attached to the rear axle 14 are wheel(s) 16 and 18. A suitable type wheel for this application is a wheel which is 10 inches in diameter and 2½ inches wide, such as that made by Tennessee Wheel.

At the front end of the frame 12 is the front axle 20 which may be made of 1¼ inch diameter steel and is 28 inches in length. Attached to the front axle 20 is a left and right front wheel 22, 24. For the purposes of this application the front wheels may be 10 inches in diameter, 2½ inches wide. This wheel can be the same wheel as the rear wheel(s) 16, 18 made by Tennessee Wheel.

The wheel drive motor 26 can be sized according to the sawing needs of a particular model, which would be well known to a person working in this field. To the wheel drive motor is coupled a first sprocket 32, to which is linked the primary chain 28, which drives the rear axle 14. On the rear axle 14, is a second sprocket 34, which is shown in FIG. 3. The wheel drive motor 26, turns the rear axle, by use of the primary chain 28, the rear axle 14 rotates. Attached to the rear axle 14, is a fourth sprocket 38, which is linked via a secondary chain 30, to a third sprocket 36, on the front axle 20. The axles drive chains and sprockets are shown to better advantage on FIG. 3. Shown in FIG. 1 is a saw blade 40 may be driven by its own motor or from the same motor that drives the front wheels.

Figure 2:
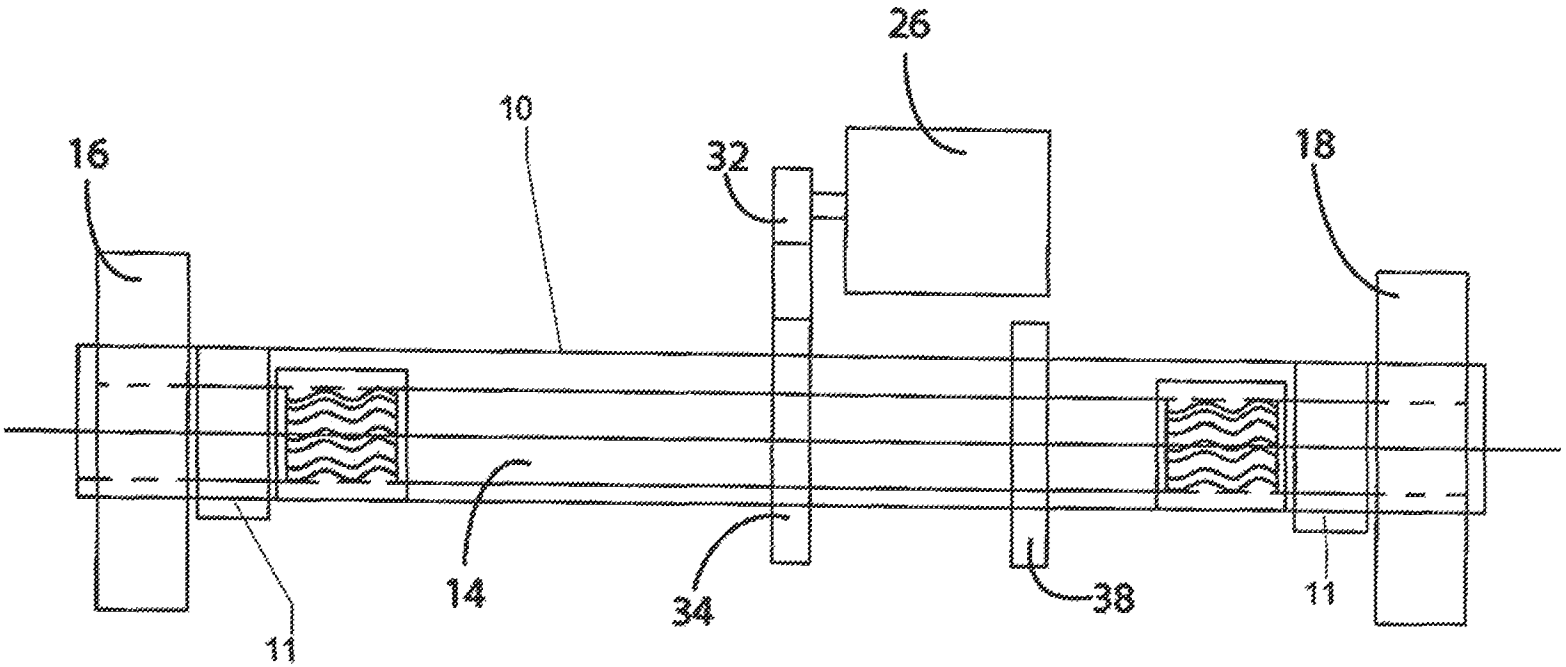
FIG. 2 is a view of the rear of the concrete saw.

FIG. 2 shows the rear of the saw, with the rear wheels and axle, and the motor 26.

Shown in FIG. 3 is a side view of the concrete saw showing a lift cylinder 54 which attaches at its lower end to the forward portion of frame 12, and the other end to the concrete saw 10. When the lift cylinder 54 extends, it raises the main frame lifts the forward portion of horizontal plate 10 and its attached saw blade relative to frame 12 and the front and rear wheels, which remain firmly on planted on the concrete surface. The saw blade assembly, not shown as it plays no part of this invention, is attached to concrete saw 10, and is at its maximum designed depth of cut when concrete saw is fully lowered and rests atop the forward portion of frame 12. As the forward portion of concrete saw 10 is rotated up the saw blade is also lifted up, and when the forward portion of concrete saw is fully lifted the saw blade will be fully withdrawn from the concrete cut at some elevation above the concrete surface.

Figure 4:
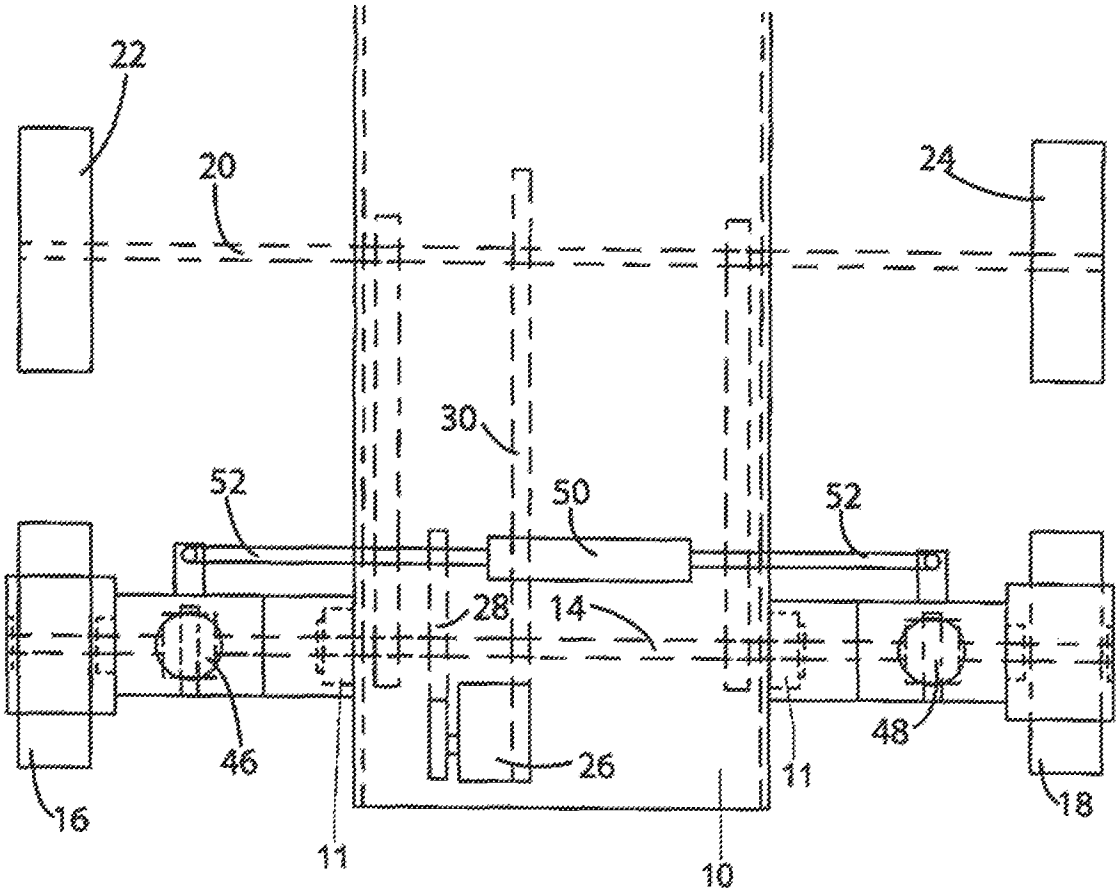
FIG. 4 is a top view of the rear steering of the concrete saw.

Shown in FIG. 4 is the drive mechanism associated with the rear axle 14 of the concrete saw. Shown in FIG. 4 are the front axle 20, the left front wheel 22, the right front wheel 24, the rear axle 14, the left rear wheel 16, and the right rear wheel 18. Also shown is the wheel drive motor 26, which is connected to the rear axle by the primary chain 28, which is connected to the front axle by the secondary chain 30. Shown is rear left king pin 46, and rear right king pin 48. Shown at 50, is the rear steering cylinder which is connected to the left and right rear king pins, 46 and 48, by tie rods, 52.

Figure 5:
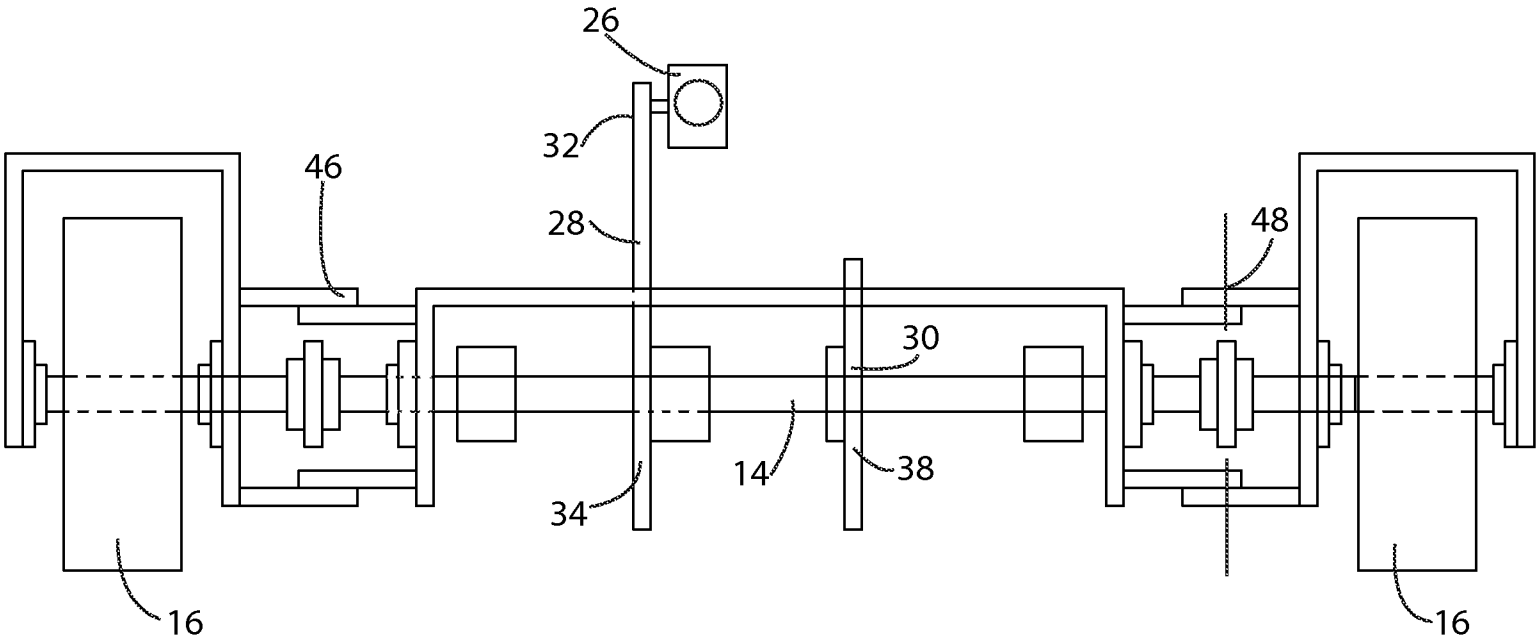
FIG. 5 is a rear view of the rear axle.

Shown in FIG. 5 is a front view of the rear axle 14 of the invention. Shown is the wheel drive motor 26, to which is attached a first sprocket 32. The primary chain 28, on the first sprocket 32, connects to a second sprocket 34, on the rear axle 14. Attached to the rear axle 14 are a fourth sprocket 38, and a secondary chain 30. Shown in FIG. 5, are the rear left king pin 46, and the rear right king pin 48.

While certain exemplary embodiments are shown in the Figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A front wheel drive concrete saw, comprising:

a saw frame and at least one rear axle and at least one rear wheel;

a left and a right front wheel on a front axle, with both of said wheels being powered for pulling said saw frame while said saw is engaged in cutting concrete below said wheels;

a wheel drive motor attached to said frame and is connected to said rear wheels and to said front wheels by chains and gears, with a primary chain providing power to said rear axle and a secondary chain providing power to said front axle, with a first sprocket on said wheel drive motor, and a second sprocket on a rear wheel axle, and a third sprocket on said front axle and a fourth sprocket on said rear axle, with said fourth sprocket on said rear wheel axle connected to said secondary drive chain and to said third sprocket on said front axle;

a concrete saw blade attached to said frame and to a saw motor;

a blade lifting mechanism for raising and lowering said saw blade from a transport position to a cutting position; and with said saw blade configured to rotate to a position below said saw frame in order to saw concrete below said wheels.

2. An all wheel drive concrete saw, comprising:

a saw frame with a motor attached, said motor configured to power rear and front wheels by means of a first sprocket and a primary chain;

a front axle with at least one front wheel, with a third sprocket on said front axle;

a rear axle with a left and right rear wheel, with a second sprocket on said rear axle for connection to said drive motor and said primary drive chain and said first sprocket, and a fourth sprocket on said rear axle for connection to a secondary drive and to said a third sprocket on a said front axle, for connection to said rear axle by said secondary drive chain, and said fourth sprocket on said rear axle;

a concrete saw blade operatively connected to said frame and to a saw motor; and with said rear wheels drivingly connected to said at least one front wheel and configured to transfer power from said rear wheels to said at least one front wheel to achieve all wheel drive.

3. An all wheel drive concrete saw, comprising:

a saw frame and at least one front axle and at least one front wheel;

a left and a right rear wheel on a rear axle, with both of said rear wheels being powered for pulling said saw frame while said saw is engaged in cutting concrete below said wheels;

a wheel drive motor attached to said frame and is connected to said rear wheels and to said front wheel by chains and gears, with a primary chain providing power to said rear axle and a secondary chain providing power to said front axle, with a first sprocket on said wheel drive motor, and a second sprocket on a rear wheel axle, and a third sprocket on said front axle and a fourth sprocket on said rear axle, with said fourth sprocket on said rear wheel axle connected to said secondary drive chain and to said third sprocket on said front axle;

a concrete saw blade attached to said frame and to a saw motor;

a blade lifting mechanism for raising and lowering said saw blade from a transport position to a cutting position; and with said saw blade configured to rotate to a position below said saw frame in order to saw concrete below said wheels.

* * * * *